US008152857B2

(12) United States Patent
Dauner et al.

(10) Patent No.: US 8,152,857 B2
(45) **Date of Patent: *Apr. 10, 2012**

(54) TENSION-FREE ELASTIC TAPE

(75) Inventors: Martin Dauner, Esslingen (DE); Erhard Müller, Stuttgart (DE); Heinrich Planck, Nuertingen (DE); Hans-Gerd Schmees, Wannweil (DE); Diethelm Wallwiener, Tuebingen (DE)

(73) Assignee: Deutsche Institute fur Textil-und Faserforschung, Denkendorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/016,321

(22) Filed: Jan. 28, 2011

(65) Prior Publication Data

US 2011/0130623 A1 Jun. 2, 2011

Related U.S. Application Data

(63) Continuation of application No. 10/468,188, filed as application No. PCT/EP02/01295 on Feb. 8, 2002, now Pat. No. 7,901,415.

(30) Foreign Application Priority Data

Feb. 17, 2001 (DE) ..... 101 07 521

(51) Int. Cl.
*A61F 2/02* (2006.01)

(52) U.S. Cl. ..... 623/23.72; 606/151

(58) Field of Classification Search ..... 606/151, 606/213; 623/23.72, 13.15–13.19, 13.2; 600/37; 602/44, 76; 442/181–319
See application file for complete search history.

(56) References Cited

U.S. PATENT DOCUMENTS

| | | | |
|---|---|---|---|
| 1,428,465 | A | 9/1922 | Willmott |
| 1,518,798 | A | 12/1924 | Kendrick |
| 1,533,544 | A | 4/1925 | Fox |
| 1,772,955 | A | 8/1930 | Moore |
| 1,867,183 | A | 7/1932 | Simons |
| 1,887,927 | A | 11/1932 | Fox |
| 1,949,318 | A | 2/1934 | Markowsky |
| 1,950,559 | A | 3/1934 | Kendrick |
| 3,124,136 | A | 3/1964 | Usher |
| 3,190,289 | A | 6/1965 | Patience |
| 3,618,754 | A | 11/1971 | Hoey |
| 3,787,272 | A | 1/1974 | Nisbet et al. |
| 3,845,641 | A | 11/1974 | Waller |
| 3,965,703 | A | 6/1976 | Barnhardt |
| 4,323,061 | A | 4/1982 | Usukura |
| 4,452,245 | A | 6/1984 | Usher |
| 4,677,011 | A | 6/1987 | Matsuda |

(Continued)

FOREIGN PATENT DOCUMENTS

| | | | |
|---|---|---|---|
| DE | 466736 | C | 10/1928 |

(Continued)

*Primary Examiner* — Melanie Tyson
(74) *Attorney, Agent, or Firm* — The Nath Law Group; Jerald L. Meyer; Robert T. Burns

(57) ABSTRACT

A tension-free elastic tape is used for the surgical treatment of female urinary incontinence. The tape has a textile structure that allows ingrowth of the tape into the connective tissue. On its longitudinal edges, the tape has edge threads (2, 4, 6, 8) that project from the textile structure of the tape and that especially facilitate a good primary anchoring of the tape in the tissue. The edge threads are firmly incorporated in the structure of the tape.

25 Claims, 3 Drawing Sheets

U.S. PATENT DOCUMENTS

| | | | |
|---|---|---|---|
| 4,733,545 | A | 3/1988 | Weinle et al. |
| 4,839,215 | A | 6/1989 | Starling et al. |
| 4,942,875 | A | 7/1990 | Hlavacek et al. |
| 5,265,445 | A | 11/1993 | Shytles et al. |
| 5,280,887 | A | 1/1994 | Fontana |
| 5,373,712 | A | 12/1994 | Yamamoto et al. |
| 5,456,711 | A | 10/1995 | Hudson |
| 5,458,636 | A | 10/1995 | Brancato |
| 5,522,240 | A | 6/1996 | Wall et al. |
| 5,540,982 | A | 7/1996 | Scholz et al. |
| 5,569,273 | A | 10/1996 | Titone et al. |
| 5,658,650 | A | 8/1997 | Neamy et al. |
| 5,885,910 | A | 3/1999 | Graichen |
| 5,899,909 | A | 5/1999 | Claren et al. |
| 5,990,378 | A | 11/1999 | Ellis |
| 6,123,667 | A | 9/2000 | Poff et al. |
| 6,547,820 | B1 | 4/2003 | Staudenmeier |
| 7,112,210 | B2 | 9/2006 | Ulmsten et al. |
| 7,901,415 | B2 * | 3/2011 | Dauner et al. ..... 606/151 |
| 2002/0115369 | A1 | 8/2002 | Yokoyama et al. |

FOREIGN PATENT DOCUMENTS

| | | | |
|---|---|---|---|
| DE | 25 43 265 | A1 | 7/1976 |
| DE | 198 32 634 | | 1/2000 |
| DE | 102 31 975 | A1 | 2/2004 |
| WO | 97/02789 | A | 1/1997 |

* cited by examiner

TENSION-FREE ELASTIC TAPE

RELATED APPLICATION(S)

The present Patent Application is a Continuation of U.S. patent application Ser. No. 10/468,188, with the filing date of Feb. 9, 2004, now U.S. Patent No. 7,901,415, which is a National Phase Application filed under 35 U.S.C. 371 as a national stage of PCT/EP02/01295, filed Feb. 8, 2002, which claims priority to German Patent Application DE 101 07 521.9, filed Feb. 17, 2001, the content each of which is hereby incorporated by reference in its entirety.

BACKGROUND

1. Field

This disclosure relates to a tension-free elastic tape for the surgical treatment of female urinary incontinence, the textile structure of which enables the ingrowth of the connective tissue.

2. Background

Female urinary incontinence is often produced by weakness in the connective tissue. Therefore, to treat it, a surgical procedure is inter alia used in which a tension-free elastic tape is inserted which supports the urethra, strengthens the connective tissue and serves as a matrix for the ingrowth of regenerated connective tissue. This surgical procedure is described, for example, in U.S. Pat. No. 5,899,909 in which a generic tape suitable for this surgical procedure is also claimed.

This known tape has a relatively high rigidity which can make the insertion of the tape more difficult. The tape is cut as a strip from a textile surface material. This results in free monofil ends on the longitudinal edges of the tape. When the tape is inserted, these free ends facilitate a primary anchoring of the tape in the tissue. However, the cutting of the textile surface material during production of the tapes leads to the mesh unraveling on the wall edges, so that particles can break off on the edge during insertion and also post-operatively. Both the projecting monofil ends and the separated, in particular, sharp-edged monofil particles can cause lasting inflammations. In addition, the unraveling of the edge stitches reduces the strength of the tape which must be compensated by an increased use of material.

SUMMARY

A tension free elastic tape for the surgical treatments, is constructed to have a textile structure in the form of a knitted fabric, having a first thread pattern of base threads, with the textile structure enabling the ingrowth of the connective tissue. Edge threads provided at the edges of the tape in a direction parallel to a longitudinal direction of the tape form a looped second thread pattern that projects from longitudinal edges of the thread pattern of base threads. The knitted fabric is completed in the peripheral area by the edge threads forming loops on the two longitudinal edges of the tape, and the loops project laterally in a plane of the tape beyond the edge of the tape without open ends. The loops edge threads ensure a primary anchoring of the tape without coming undone from the textile structure of the tape, and providing a primary anchoring of the tape in the tissue, the edge threads directly and firmly incorporated in the structure of the first thread pattern of said base threads.

BRIEF DESCRIPTION OF THE DRAWINGS

The disclosed subject matter will be described in greater detail in the following with reference to the embodiments illustrated in the drawings, showing.

DETAILED DESCRIPTION

Figure 1:
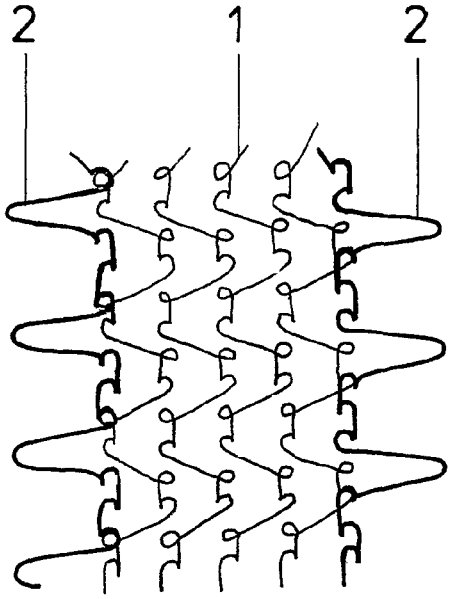
FIG. 1 a first embodiment of the tape,
FIG. 2 a second embodiment of the tape,
FIG. 3 a third embodiment of the tape,
FIG. 4 a fourth embodiment of the tape, and
FIG. 5 a fifth embodiment of the tape.

The disclosed subject matter provides a tape which overcomes or reduces the aforementioned problems and, in particular, combines a good primary anchoring with a minimal tissue irritation This is addressed by providing a tape having edge threads on its longitudinal edges which project from the textile structure of the tape for a primary anchoring of the tape in the tissue and which are firmly incorporated in the structure of the tape.

The tape which is suitable for the surgical treatment of female urinary incontinence is dimensioned in such a way that its length is substantially greater than its width, for example, more than twenty times the width. Typically, a tape of this type can have e.g. a length of 450 mm and a width of 10 mm.

The disclosed techniques use edge threads provided on the longitudinal edges of the tape which, on the one hand, project from the textile structure of the tape to ensure a good primary anchoring of the tape, and which, on the other hand, do not come undone from the textile structure of the tape.

In one embodiment, the edge threads thereby form loops which have a relatively large opening, so that the tissue can penetrate directly into the openings of these loops and a quick and good primary anchoring is produced. The permanent stabilization of the tape in the tissue can also be facilitated by these loops. The size of the loop opening is preferably greater than 0.01 $mm^2$, preferably from 0.02 to 1 $mm^2$ The loops are thereby incorporated in the textile structure of the tape, so that they cannot come undone from the tape. Since the loops do not have any free ends, they do not cause an irritation of the tissue which could result in long-lasting inflammations.

In another embodiment, a textile surface structure is produced, the width of which corresponds to a multiple of the width of the individual tape and which is divided into the individual tapes. It is thereby advantageous to provide points of insertions deviating from the structure provided for the tapes by open eye-pointed needles, in the area of which these structures are to be separated into individual tapes. This enables a simple separation, in particular also a mechanical separation. The separation can be accomplished in several ways, e.g. by chemical or physical action. A cutting process can be performed by means of a mechanical cutter, by means of a thermocutting wire or also by means of an ultrasound cutting device. In particular, the thermocutting and ultrasound cutting thereby have the advantage that the separated threads which form the edge threads of the tapes do not have any sharp-edged separation points when the process is conducted appropriately. Therefore, long-lasting inflammation irritations are not caused by the edge threads. To prevent the separated edge threads from becoming undone from the structure of the separated tape, said edge threads are made with a long underlay in the textile structure and connected in several rows of stitches. In an especially preferred embodiment, the edge threads to be separated consist of a reabsorbed filament.

The tape must have a sufficient tensile strength to support the urethra in the tightened state. Similarly, the tape must exhibit sufficient elasticity to be able to yield and follow the anatomical tissue movements. To obtain the required tensile strength and elasticity, the textile structure of the tape is preferably in the form of a knitted fabric, e.g. as in a tricot, cloth and velvet texture, such that both the primary hooking and the ingrowth of tissue is facilitated.

The tape can consist predominantly or exclusively of monofils or of multifils. The same filament material can thereby be used for the entire tape. If the tape consists of a non-reabsorbed material, then the tape remains permanently in the tissue as a supporting matrix. If a sufficient connective tissue proliferation is to be expected, then a reabsorbed material can also be used. The tape then dissolves and is reabsorbed once the connective tissue has again attained sufficient stability.

Preferably, the tape is made from two or, optionally, more different filament materials. As a result, the mechanical properties of the tape can be optimized. It is of particular advantage to produce the tape from a reabsorbable and a non-reabsorbable filament material. The scar formation and with it the permanent anchoring is facilitated by reabsorption of the material. This can be solved by reabsorbed filaments or by a reabsorbed coating of a non-reabsorbing or slow-reabsorbing filament. In particular, the edge threads can thereby consist of a reabsorbable material. These edge threads are primarily used for the primary anchoring of the tape during and after the operation. As soon as the tape has been permanently anchored by sprouting in the connective tissue, the edge threads can be reabsorbed. This permanently rules out a tissue irritation by the edge threads. Furthermore, the entire textile structure of the tape can be produced by a combination of reabsorbable and non-reabsorbable filaments. During the surgical insertion, the tape can have a slight mesh size which is produced by the reabsorbed and non-reabsorbed filaments. This ensures a high stabilization effect of the tape. Due to the later reabsorption of the reabsorbable filament, the tape then continues to have the larger stitch width of the still remaining, non-reabsorbed filament, so that a good ingrowth of the connective tissue into the tape is facilitated. A rough surface, e.g. having the terry cloth texture, or the increased scar formation by reabsorbed threads, can be undesirable in the area of the bladder. This is preferably solved by a change of the binding over the implant length. For example, the anchoring area is formed by a terry cloth structure, while e.g. a tricot binding or a bath is carried out in the area of the bladder.

Basically, all thread-forming biocompatible polymers can be used. Of the group of non-reabsorbable polymers, these are in particular polyethylene PE, polypropylene PP, polyester (e.g. polyethylene terephthalate PET and polybutylene terephthalate PBT), polyvinylidene fluoride PVDF, polytetrafluoroethylene PTFE and other fluoride-containing polymers as well as polyurethane PUR, polyetherketone and polyphenylene sulfide. The reabsorbable polymers are preferably selected from the group of alpha and beta hydroxycarboxylic acids. Preferably, short-term reabsorbable polymers such as polyglycolic acids PGA are suitable. Slow reabsorbing polymers such as polylactides can also be used. This results in a special advantage if the implant is to be sterilized by ionizing radiation. Copolymers and terpolymers with one another and with elastifizing components such as caprolactone and trimethylene carbonate are suitable. Finally, polyester amides or other reabsorbable biocompatible thread-forming polymer materials are also suitable. The reabsorption time of these materials can be influenced with the known methods of ionizing radiation, a sterilization of the tape to be implanted taking place simultaneously.

The edge threads projecting in the form of a loop or hook used for the primary anchoring would prevent inserting the tape through the tissue during the operation and lead to an additional traumatization of the tissue. For this reason, for inserting into the tissue, the tape is preferably surrounded with a tubular sheath which can be easily removed after the tape has been positioned, as is also already known from U.S. Pat. No. 5,899,909. The tube may consist of any short-term biocompatible material, for example, of a material used for the production of catheters (e.g. polyamide, polypropylene, polyethylene, polyvinyl chloride). After the tape has been positioned, the sheath is pulled off of the tape over its length. To this end, the sheath can be preferably provided with a preset perforation in the central area of its longitudinal extension or can be placed about the tape as an open splice.

Preferably, the tape is pulled through the tissue by means of atraumatic needles. In this case, reusable needles are especially preferred. For a secure, detachable and also intraoperatively manageable connection of the tape and the sheath to the needles, they are preferably each provided with an adapter on both ends, which can be coupled with a corresponding adapter of the needles. The adapter mechanism can be in the form of a screw connection, Luer lock, slide lock or snap connection. It consists of a biocompatible solid material, preferably from a polymer construction material, such as e.g. polyamide, polyoxymethylene, polyethylene ketone, polypropylene, polyethylene or polyester. The tape and optionally the sheath are connected with the adapter by welding, gluing, clamping or a shrink-on tubing. In an especially preferred embodiment, the adapters are sprayed directly onto the tape and optionally the sheath.

In the first embodiment of FIG. 1, the tape is knitted from base threads 1 in a modified tricot binding. The knitted fabric is completed in the peripheral area by a further binding in such a way that the edge threads 2 each form loops on the two longitudinal edges of the tape, said loops projecting laterally beyond the edge of the tape. The loops of the edge threads 2 have an opening of about 0.02 to 1.0 $mm^2$ Since the edge threads 2 are incorporated in the knitted structure of the base threads 1, they are firmly connected with the tape. Since the edge threads 2 do not have any open ends, they do not cause any injuries or irritations of the tissue. However, the large loops of the edge threads 2 produce a secure primary anchoring of the tape when inserted into the tissue. Moreover, the large openings of the loops of the edge threads 2 facilitate the ingrowth of the tissue in the structure of the tape and thus a permanent anchoring of the tape in the tissue.

Figure 2:
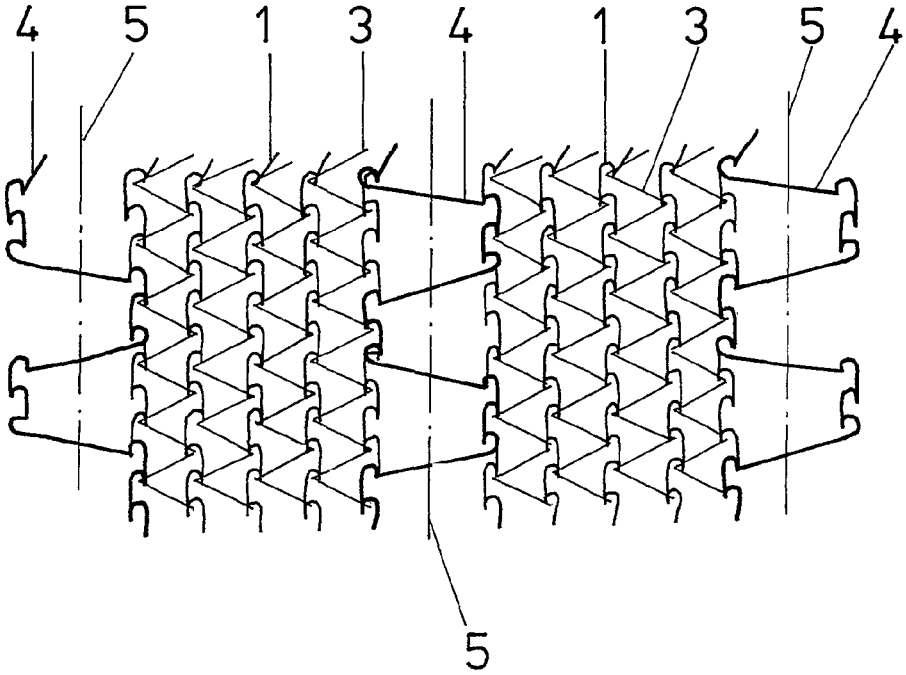

In the second embodiment shown in FIG. 2, a textile surface structure is produced which is then divided into individual tapes. In FIG. 2, only two of the tapes are shown for illustration and the additional tapes are produced by a periodic repetition of the illustrated structure.

In the second embodiment, the base threads 1 are in the form of fringes which are interconnected by partial wefts 3 to form tapes. In this way, a plurality of parallel running tapes are produced. These tapes are thereby connected with one another by connecting threads 4 to form the surface structure. To separate the individual tapes from this surface structure, the connecting threads 4 between the individual tapes are detached along dividing lines 5. The connecting threads 4 are preferably separated by ultrasound cutting or by thermocutting, as a result of which the cutting edges of the free ends of the connecting threads 4 which then remain are rounded.

After the connecting threads 4 have been separated and the tapes detached, the connecting threads 4 form the edge threads of the tape. The separated free ends of these edge threads project from the structure of the tapes and form hooks which are effective for the primary anchoring of the tape. The rounding of the cut ends reduces the irritation of the tissue by these projecting edge threads. Preferably, the connecting threads 4 are made of soluble or reabsorbable filaments.

The connecting threads 4 are each worked into the tape structure by a number of rows of meshes before they are led to the edge of the adjacent tape. As a result, the connecting threads 4 are secured in the tape fabric by being joined in several mesh rows, so that they also do not become loose from the tape fabric after they have been separated without a considerable mechanical action.

Figure 3:
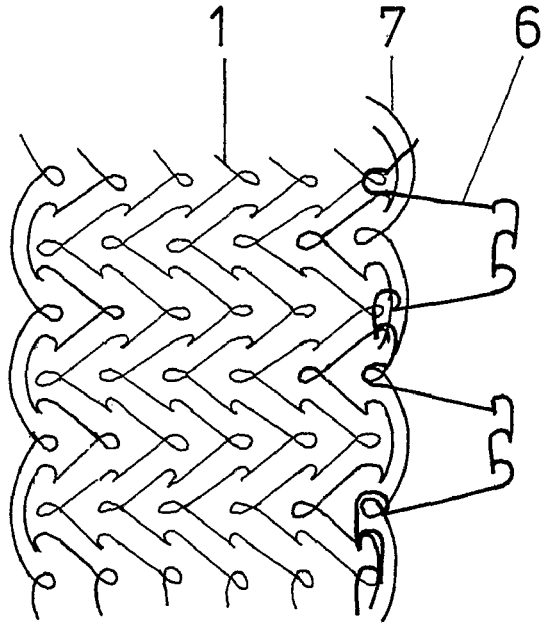

In the third embodiment shown in FIG. 3, the base threads 1 form a knitted fabric. Edge threads 6 are incorporated in this fabric and formed into large loops projecting beyond the longitudinal edges of the tape. In this case also, the loops of the edge threads 6 ensure a secure primary anchoring without causing an irritation of the tissue. To obtain a clean bound edge, the edge threads 6 are additionally secured by a floating 7.

Figure 4:
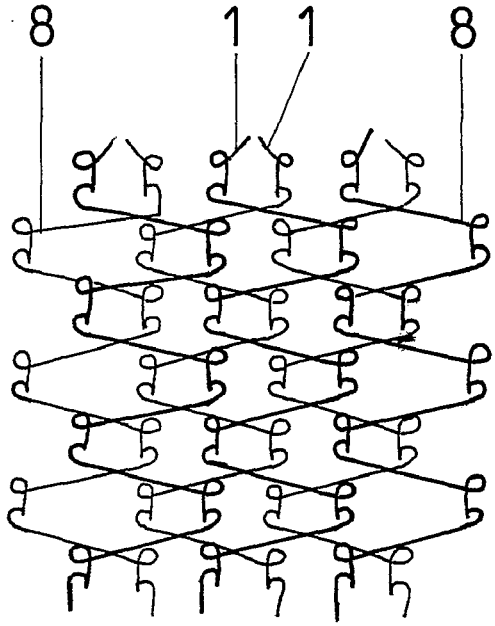

In the fourth embodiment shown in FIG. 4, the base threads 1 are netted to form a honeycombed tape. Each of the outermost base threads extending on the longitudinal edges of the tape form edge threads 2 which form loops projecting beyond the edge of the tape and have a large diamond-shaped opening 8. These loops produce a primary anchoring of the tape in the tissue and facilitate the ingrowth of the tissue for a permanent stabilization of the tape.

Figure 5:
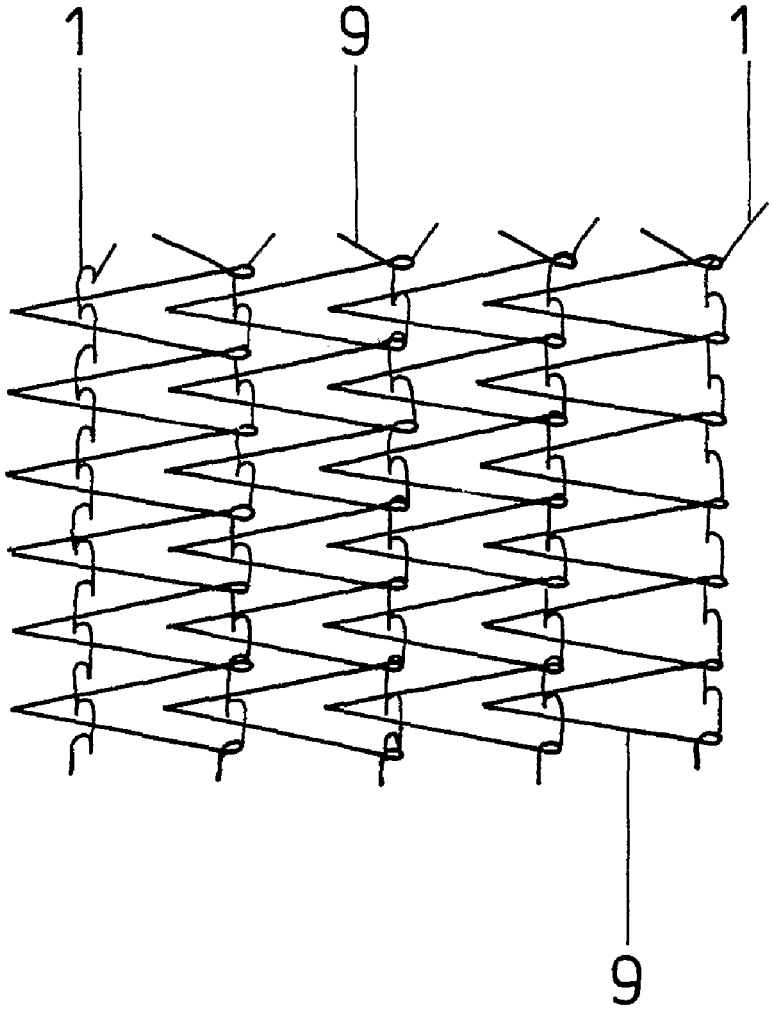

In the fifth embodiment shown in FIG. 5, the base threads 1 are in the form of fringes. A combination consisting of threads 9, mesh and weft is placed on intermediate needles, so that loops are formed over the entire width of the tape which facilitate the primary anchoring and the permanent ingrowth of the tissue.

What is claimed is:

1. Tension-free elastic tape for surgical treatments, comprising:

tape having a textile structure in the form of a knitted fabric, wherein the textile structure enables the ingrowth of connective tissue, the textile structure of the tape comprised of a first thread pattern of base threads, and whereby the tape has longitudinal edges; and edge threads provided at the edges of the tape in a direction parallel to a longitudinal direction of the tape, the edge threads forming a looped second thread pattern that projects from the longitudinal edges of the thread pattern of base threads and the knitted fabric completed in the peripheral area by the edge threads forming loops on the two longitudinal edges of the tape, said loops projecting laterally in a plane of the tape beyond the edge of the tape without open ends, the loops configured with loop openings greater than 0.01 $mm^2$ at the longitudinal edges of the tape, the edge threads provided on the longitudinal edges of the tape and projecting from the textile structure of the tape to ensure a primary anchoring of the tape without coming undone from the textile structure of the tape, and providing a primary anchoring of the tape in the tissue, the edge threads directly and firmly incorporated in the structure of the first thread pattern of said base threads.

2. The tape according to claim 1, wherein the knitted fabric comprises a terry cloth.

3. The tape according to claim 1, characterized in that the tape is formed primarily or exclusively of monofils.

4. The tape according to claim 1, characterized in that the tape is formed primarily of multifils.

5. The tape according to claim 1, wherein the tape comprises non-reabsorbable material.

6. The tape according to claim 1, further comprising:

at least two different filament materials forming the tape; and a reasorbable material provided as at least one of the filament materials.

7. The tape according to claim 1, characterized in that the edge threads comprise reabsorbable filament material.

8. The tape according to claim 1, characterized in that the edge threads project from the first thread pattern of the base thread with their free ends and are directly incorporated or anchored in the first thread pattern of the base thread.

9. The tape according to claim 1, further comprising a floating thread securing the edge threads.

10. The tape according to claim 1, characterized in that the threads comprises a non-reabsorbable polymer material selected from the group consisting of polyethylene (PE), polypropylene (PP), polyester, polyvinylidene fluoride (PVDF), polytetrafluoroethylene (PTFE), other fluoride-containing polymers, polyurethane (PUR), polyetherketone and polyphenylene sulfide.

11. The tape according to claim 1, characterized in that the threads comprises a reabsorbable polymer material selected from the group consisting of alpha and beta hydroxycarboxylic acids, polyglycolic acids (PGA), reabsorbing polymers and polyester amides.

12. The tape according to claim 1, characterized in that:

the tape's length exceeds the tape's width by more than twenty times, such that a ratio of the length to the width exceeds 20.

13. The tape according to claim 1, characterized in that:

the tape has a length in the longitudinal direction substantially greater than a width of the tape, such that a ratio of the length to the width exceeds 20; and the edge threads provided at the edges of the tape in the longitudinal direction project from the first thread pattern of the base thread with their free ends, with the edge threads directly incorporated or anchored in the first thread pattern of the base thread.

14. Tension-free elastic tape for surgical treatments, comprising:

tape having a textile structure in the form of a knitted fabric, wherein the textile structure enables the ingrowth of connective tissue, the textile structure of the tape comprised of a first thread pattern of base threads, and whereby the tape has longitudinal edges; and edge threads provided at the edges of the tape in a direction parallel to a longitudinal direction of the tape, the edge threads forming a looped second thread pattern that projects from the longitudinal edges of the thread pattern of base threads and the knitted fabric completed in the peripheral area by the edge threads forming loops on the two longitudinal edges of the tape, said loops projecting laterally in a plane of the tape beyond the edge of the tape without open ends, the loops configured with loop openings greater than 0.02 $mm^2$ at the longitudinal edges of the tape, the edge threads provided on the longitudinal edges of the tape and projecting from the textile structure of the tape to ensure a primary anchoring of the tape without coming undone from the textile structure of the tape, and providing a primary anchoring of the tape in the tissue, the edge threads directly and firmly incorporated in the structure of the first thread pattern of said base threads.

15. The tape according to claim 14, wherein the knitted fabric comprises a terry cloth.

16. The tape according to claim 14, characterized in that the tape is formed primarily or exclusively of monofils.

17. The tape according to claim 14, characterized in that the tape is formed primarily of multifils.

18. The tape according to claim 14, wherein the tape comprises non-reabsorbable material.

19. The tape according to claim 14, further comprising:

at least two different filament materials forming the tape; and a reasorbable material provided as at least one of the filament materials.

20. The tape according to claim 19, characterized in that the edge threads consist of reabsorbable filament material.

21. The tape according to claim 14, characterized in that the edge threads project from the first thread pattern of the base thread with their free ends and are directly incorporated or anchored in the first thread pattern of the base thread.

22. The tape according to claim 14, further comprising a floating thread securing the edge threads.

23. The tape according to claim 14, characterized in that the threads comprises a non-reabsorbable polymer material selected from the group consisting of polyethylene (PE), polypropylene (PP), polyester, polyvinylidene fluoride (PVDF), polytetrafluoroethylene (PTFE), other fluoride-containing polymers, polyurethane (PUR), polyetherketone and polyphenylene sulfide.

24. The tape according to claim 14, characterized in that the threads comprises a reabsorbable polymer material selected from the group consisting of alpha and beta hydroxycarboxylic acids, polyglycolic acids (PGA), reabsorbing polymers and polyester amides.

25. The tape according to claim 14, characterized in that:

the tape has a length in the longitudinal direction substantially greater than a width of the tape, such that a ratio of the length to the width exceeds 20; and the edge threads provided at the edges of the tape in the longitudinal direction project from the first thread pattern of the base thread with their free ends, with the edge threads directly incorporated or anchored in the first thread pattern of the base thread.

* * * * *